US011028331B2

(12) United States Patent
Hoehn et al.

(10) Patent No.: US 11,028,331 B2
(45) Date of Patent: Jun. 8, 2021

(54) PROCESS FOR RECOVERING HYDROCARBON FROM HYDROPROCESSED GASEOUS STREAM

(71) Applicant: UOP LLC, Des Plaines, IL (US)

(72) Inventors: Richard K. Hoehn, Mount Prospect, IL (US); Olga I. Griswold, Buffalo Grove, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/662,142

(22) Filed: Oct. 24, 2019

(65) Prior Publication Data

US 2020/0131445 A1 Apr. 30, 2020

Related U.S. Application Data

(60) Provisional application No. 62/751,042, filed on Oct. 26, 2018.

(51) Int. Cl.
*C10G 67/06* (2006.01)
*C10G 67/14* (2006.01)

(52) U.S. Cl.
CPC ..... *C10G 67/14* (2013.01); *C10G 2300/202* (2013.01); *C10G 2300/207* (2013.01)

(58) Field of Classification Search
CPC .. C10G 67/14; C10G 67/06; C10G 2300/202; C10G 2300/207
See application file for complete search history.

(56) References Cited

U.S. PATENT DOCUMENTS 5,045,177 A * 9/1991 Cooper ..... C10G 70/06 208/131
2003/0111386 A1* 6/2003 Mukherjee ..... C10G 47/20 208/58
2015/0047503 A1* 2/2015 Hoehn ..... C01B 3/52 95/92
2017/0283715 A1 10/2017 Ladkat

* cited by examiner

*Primary Examiner* — Michelle Stein
(74) *Attorney, Agent, or Firm* — Paschall & Associates, LLC; James C. Paschall

(57) ABSTRACT

A process for recovery of $C_5$+ hydrocarbons from a stripper gaseous hydroprocessed stream by contacting it with a stripper liquid stream. The stripper liquid stream absorbs $C_5$+ hydrocarbons predominantly over other hydrocarbons thereby increasing $C_5$+ yield and enabling the stripper gaseous stream to meet hydrocarbon limits. The rich absorbent stream may be sent to recovery with the stripper liquid from whence it came.

19 Claims, 1 Drawing Sheet

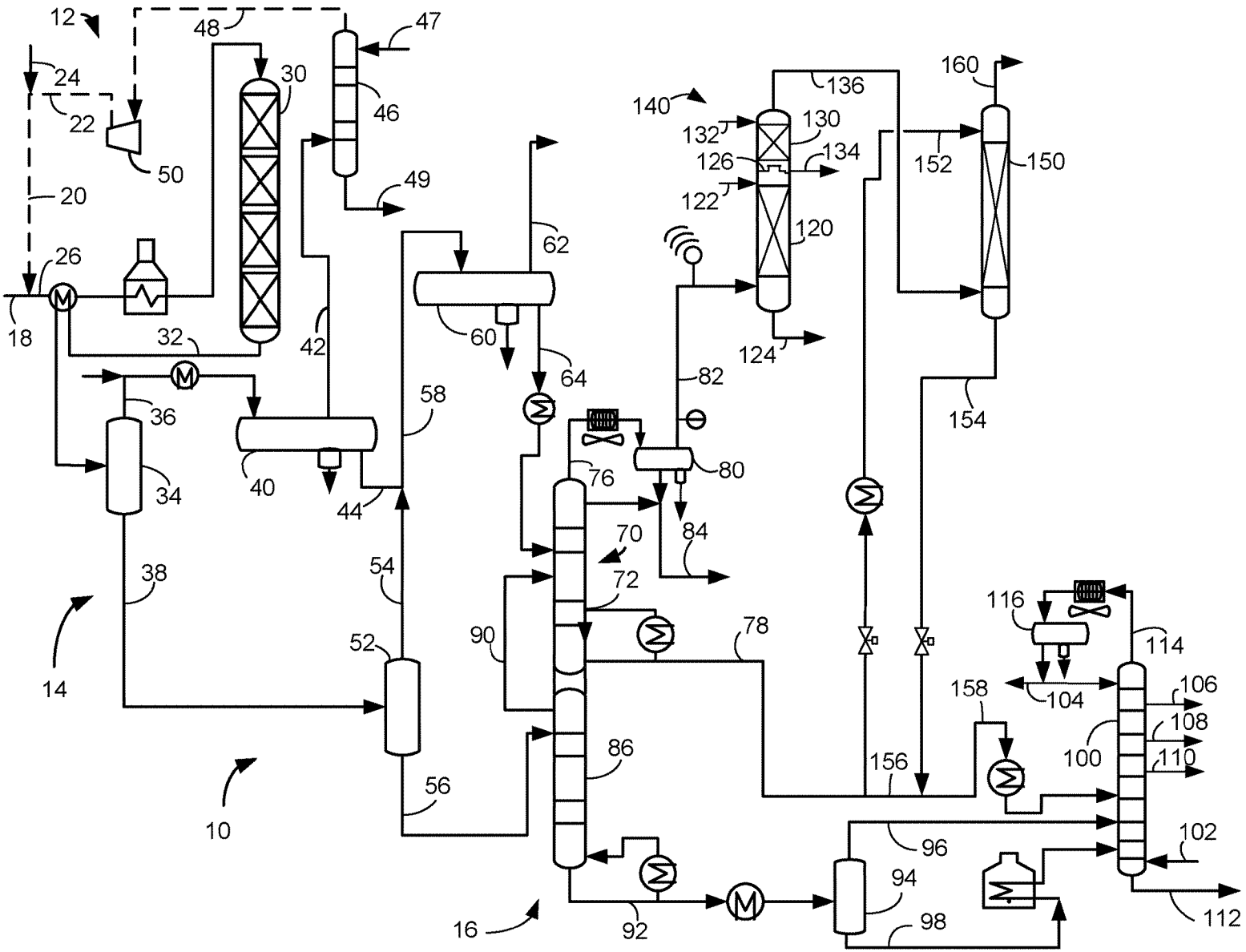
10
12
14
16
18
20
22
24
26
30
32
34
36
38
40
42
44
46
47
48
49
50
52
54
56
58
60
62
64
70
72
76
78
80
82
84
86
90
92
94
96
98
100
102
104
106
108
110
112
114
116
120
122
124
126
130
132
134
136
140
150
152
154
156
158
160

PROCESS FOR RECOVERING HYDROCARBON FROM HYDROPROCESSED GASEOUS STREAM

CROSS-REFERENCE TO RELATED APPLICATIONS

This application claims priority from provisional application 62/751,042, filed Oct. 26, 2018, incorporated herein in its entirety.

FIELD

The field is the hydroprocessing of hydrocarbon streams, particularly the recovery of hydrocarbon from hydroprocessed gaseous streams.

BACKGROUND

Hydroprocessing can include processes which convert hydrocarbons in the presence of hydroprocessing catalyst and hydrogen to more valuable products. Hydrocracking is a hydroprocessing process in which hydrocarbons crack in the presence of hydrogen and hydrocracking catalyst to lower molecular weight hydrocarbons. Depending on the desired output, a hydrocracking unit may contain one or more fixed beds of the same or different catalyst. Slurry hydrocracking is a slurried catalytic process used to crack residue feeds to gas oils and fuels.

Hydrotreating is a hydroprocessing process in which hydrogen is contacted with hydrocarbon in the presence of hydrotreating catalysts for the removal of heteroatoms, such as sulfur, nitrogen and metals from the hydrocarbon feedstock. In hydrotreating, hydrocarbons with double and triple bonds and aromatics may be saturated.

Hydroprocessing recovery units typically include an array of separators for cooling and depressurizing hydroprocessed effluent and separating gaseous streams from liquid streams and a stripping column for stripping hydroprocessed liquid by a reboiler or with a stripping medium such as steam to remove unwanted hydrogen sulfide. The stripped stream then is typically heated and fractionated in a product fractionation column to recover products such as naphtha, kerosene and diesel. Off-gas streams may contain hydrocarbons that may go unrecovered. Lower pressure hydrocracking and hydrotreating may omit use of the product fractionation column to recover product streams.

Some refiners require that off-gas streams supplying a fuel gas system contain no more than a fixed fraction of $C_5$+ material. Meeting such specifications can be problematic in off-gas streams containing a large amount of hydrogen which may also contain more than the specified concentration of $C_5$+ material. One solution is to lift more of the heavier material overhead in the stripper or fractionation column to produce more net overhead liquid, but this hurts the yield of bottoms product.

There is a continuing need, therefore, for improved methods of recovering hydrocarbons from hydroprocessed off-gas streams.

BRIEF SUMMARY

We have discovered a process for recovering hydrocarbons from off-gas streams. The off-gas stream is contacted with a liquid hydrocarbon stream which absorbs the heavier hydrocarbons from the gaseous stream. The liquid hydrocarbon stream enriched with $C_5$+ material can then be stored or fractionated for product recovery. We were surprised to find we can increase the bottoms $C_5$+ product by about 0.05 to about 0.10 wt %.

BRIEF DESCRIPTION OF THE DRAWING

The FIGURE is a schematic drawing of a hydroprocessing unit with a recovery section.

DEFINITIONS

The term "communication" means that fluid flow is operatively permitted between enumerated components, which may be characterized as "fluid communication". The term "communication" may also mean that data or signals are transmitted between enumerated components which may be characterized as "informational communication".

The term "downstream communication" means that at least a portion of fluid flowing to the subject in downstream communication may operatively flow from the object with which it fluidly communicates.

The term "upstream communication" means that at least a portion of the fluid flowing from the subject in upstream communication may operatively flow to the object with which it fluidly communicates.

The term "direct communication" means that fluid flow from the upstream component enters the downstream component without passing through any other intervening vessel.

The term "indirect communication" means that fluid flow from the upstream component enters the downstream component after passing through an intervening vessel.

The term "bypass" means that the object is out of downstream communication with a bypassing subject at least to the extent of bypassing.

As used herein, the term "a component-rich stream" means that the rich stream coming out of a vessel has a greater concentration of the component than the feed to the vessel.

As used herein, the term "a component-lean stream" means that the lean stream coming out of a vessel has a smaller concentration of the component than the feed to the vessel.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottoms stream back to the bottom of the column. Absorber and scrubbing columns do not include a condenser on an overhead of the column to condense and reflux a portion of an overhead stream back to the top of the column and a reboiler at a bottom of the column to vaporize and send a portion of a bottoms stream back to the bottom of the column. Feeds to the columns may be preheated. The overhead pressure is the pressure of the overhead vapor at the vapor outlet of the column. The bottom temperature is the liquid bottom outlet temperature. Overhead lines and bottoms lines refer to the net lines from the column downstream of any reflux or reboil to the column unless otherwise indicated. Stripping columns may use a reboiler at a bottom of the column or provide heating requirements and separation impetus from a fluidized inert vaporous media such as steam.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % distilled is produced using fifteen theoretical plates in a column with a 5:1 reflux ratio.

As used herein, the term "initial boiling point" (IBP) means the temperature at which a sample begins to boil using ASTM D-7169, ASTM D-86 or TBP, as the case may be.

As used herein, the term "T5" or "T95" means the temperature at which 5 volume percent or 95 volume percent, as the case may be, respectively, of a sample boils using ASTM D-86.

As used herein, the term "diesel" means hydrocarbons boiling in the range using the True Boiling Point distillation method of a T5 between about 132° C. (270° F.) and about 200° C. (392° F.), and a T95 between about 343° C. (650° F.) and about 399° C. (750° F.).

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which separator may be operated at higher pressure.

As used herein, the term "predominant" or "predominate" means greater than 50%, suitably greater than 75% and preferably greater than 90%.

DETAILED DESCRIPTION

A hydroprocessed stripper gaseous stream from a stripper overhead receiver may be scrubbed of acid gases and contacted with an absorbent stream, which may be a hydroprocessed stripped liquid stream, to recover $C_5$+ hydrocarbons from the stripper gaseous stream. We surprisingly found as much as about 0.05 to about 0.10 wt % of additional $C_5$+ hydrocarbons can be recovered in hydroprocessing recovery using this process. $C_5$+ hydrocarbons are the predominant material absorbed from the stripper gaseous stream in the rich absorbent stream.

A process 10 for hydroprocessing hydrocarbons comprises a hydroprocessing unit 12, a separation section 14, and a product recovery unit 16. A hydrocarbonaceous stream in hydrocarbon line 18 and a make-up hydrogen stream in make-up hydrogen line 24 are fed to the hydroprocessing unit 12.

A recycle hydrogen stream in recycle hydrogen line 22 may be supplemented by the make-up hydrogen stream from line 24 to provide the hydrogen stream in the hydrogen line 20. The hydrogen stream may join the hydrocarbonaceous stream in feed line 18 to provide a hydrocarbon feed stream in feed line 26. The hydrocarbon feed stream in line 26 may be heated by heat exchange with hydroprocessed effluent stream in a hydroprocessed effluent line 32 and in a fired heater and fed to the hydroprocessing reactor 30, in which the hydrocarbon feed stream is hydroprocessed.

In one aspect, the process described herein is particularly useful for hydroprocessing a hydrocarbon feed stream comprising a hydrocarbonaceous feedstock. Illustrative hydrocarbonaceous feed stocks include hydrocarbon streams including kerosene having an IBP above about 177° C. (350° F.), atmospheric gas oils having an IBP of about 260° C. (500° F.), vacuum gas oil (VGO) having T5 and T95 between about 288° C. (550° F.) and about 600° C. (1100° F.), deasphalted oil, coker distillates, straight run distillates, pyrolysis-derived oils, high boiling synthetic oils, cycle oils, hydrocracked feeds, catalytic cracker distillates, atmospheric residue having an IBP of at least about 343° C. (650° F.) and vacuum residue having an IBP of at least about 510° C. (950° F.).

Hydroprocessing that occurs in the hydroprocessing unit 12 may be hydrocracking and/or hydrotreating. Hydrocracking refers to a process in which hydrocarbons crack in the presence of hydrogen to lower molecular weight hydrocarbons. Consequently, the term "hydroprocessing" will include the term "hydrocracking" herein. Hydrocracking also includes slurry hydrocracking in which resid feed is mixed with catalyst and hydrogen to make a slurry and cracked to lower boiling products.

The hydroprocessing that occurs in the hydroprocessing unit may also be hydrotreating. Hydrotreating is a process wherein hydrogen is contacted with hydrocarbon in the presence of hydrotreating catalysts which are primarily active for the removal of heteroatoms, such as sulfur, nitrogen and metals from the hydrocarbon feedstock. In hydrotreating, hydrocarbons with double and triple bonds and aromatics may be saturated. Some hydrotreating processes are specifically designed to saturate aromatics. The cloud point or pour point of the hydrotreated product may also be reduced by hydroisomerization. Consequently, the term "hydroprocessing" will include the term "hydrotreating" herein. A hydrocracking reactor may be preceded by a hydrotreating reactor and an optional separator (not shown) to remove sulfur and nitrogen contaminants from the feed to the hydrocracking reactor.

The hydroprocessing reactor 30 may be a fixed bed reactor that comprises one or more vessels, single or multiple beds of catalyst in each vessel, and various combinations of hydrotreating catalyst and/or hydrocracking catalyst in one or more vessels. The hydroprocessing reactor 30 may be operated in a conventional continuous liquid or gas phase, a moving bed or a fluidized bed hydroprocessing reactor.

If the hydroprocessing reactor 30 is operated as a hydrocracking reactor, it may provide a total conversion of at least about 20 vol % and typically greater than about 60 vol % of the hydrocarbon feed to products boiling below the diesel cut point which may be the T95 for diesel. A hydrocracking reactor may operate at partial conversion of more than about 30 vol % or full conversion of at least about 90 vol % of the feed based on total conversion. A hydrocracking reactor may be operated at mild hydrocracking conditions which will provide about 20 to about 60 vol %, preferably about 20 to about 50 vol %, total conversion of the hydrocarbon feed to product boiling below the diesel cut point. If the hydroprocessing reactor 30 is operated as a hydrotreating reactor, it may provide conversion per pass of about 10 to about 30 vol %.

If the hydroprocessing reactor 30 is a hydrocracking reactor, the first vessel or bed in the hydrocracking reactor 30 may include hydrotreating catalyst for the purpose of saturating, demetallizing, desulfurizing or denitrogenating the hydrocarbon feed before it is hydrocracked with hydrocracking catalyst in subsequent vessels or beds in the hydrocracking reactor 30. If the hydrocracking reactor is a mild hydrocracking reactor, it may contain several beds of hydrotreating catalyst followed by a fewer beds of hydrocracking catalyst. If the hydroprocessing reactor 30 is a slurry hydrocracking reactor, it may operate in a continuous liquid phase in an upflow mode and will appear different than in the FIGURE which depicts a fixed bed reactor. If the hydroprocessing reactor 30 is a hydrotreating reactor it may comprise more than one vessel and multiple beds of hydrotreating catalyst. The hydrotreating reactor may also contain hydrotreating catalyst that is suited for saturating aromatics, hydrodewaxing and hydroisomerization.

A hydrocracking catalyst may utilize amorphous silica-alumina bases or low-level zeolite bases combined with one or more Group VIII or Group VIB metal hydrogenating components if mild hydrocracking is desired to produce a balance of middle distillate and gasoline. In another aspect, when middle distillate is significantly preferred in the converted product over gasoline production, partial or full hydrocracking may be performed in the first hydrocracking reactor 30 with a catalyst which comprises, in general, any crystalline zeolite cracking base upon which is deposited a Group VIII metal hydrogenating component. Additional hydrogenating components may be selected from Group VIB for incorporation with the zeolite base.

The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and about 14 Angstroms. It is preferred to employ zeolites having a relatively high silica/alumina mole ratio between about 3 and about 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8 and 12 Angstroms, wherein the silica/alumina mole ratio is about 4 to 6. One example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,100,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. In one aspect, the preferred cracking bases are those which are at least about 10 wt %, and preferably at least about 20 wt %, metal-cation-deficient, based on the initial ion-exchange capacity. In another aspect, a desirable and stable class of zeolites is one wherein at least about 20 wt % of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 wt % and about 30 wt % may be used. In the case of the noble metals, it is normally preferred to use about 0.05 to about 2 wt % noble metal.

The method for incorporating the hydrogenating metal is to contact the base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., about 371° C. (700° F.) to about 648° C. (1200° F.) in order to activate the catalyst and decompose ammonium ions. Alternatively, the base component may first be pelleted, followed by the addition of the hydrogenating component and activation by calcining.

The foregoing catalysts may be employed in undiluted form, or the powdered catalyst may be mixed and copelleted with other relatively less active catalysts, diluents or binders such as alumina, silica gel, silica-alumina cogels, activated clays and the like in proportions ranging between about 5 and about 90 wt %. These diluents may be employed as such or they may contain a minor proportion of an added hydrogenating metal such as a Group VIB and/or Group VIII metal. Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718.

By one approach, the hydrocracking conditions may include a temperature from about 290° C. (550° F.) to about 468° C. (875° F.), preferably 343° C. (650° F.) to about 445° C. (833° F.), a pressure from about 4.8 MPa (gauge) (700 psig) to about 20.7 MPa (gauge) (3000 psig), a liquid hourly space velocity (LHSV) from about 0.4 to less than about 2.5 $hr^{-1}$ and a hydrogen rate of about 421 $Nm^3/m^3$ (2,500 scf/bbl) to about 2,527 $Nm^3/m^3$ oil (15,000 scf/bbl). If mild hydrocracking is desired, conditions may include a temperature from about 315° C. (600° F.) to about 441° C. (825° F.), a pressure from about 5.5 MPa (gauge) (800 psig) to about 13.8 MPa (gauge) (2000 psig) or more typically about 6.9 MPa (gauge) (1000 psig) to about 11.0 MPa (gauge) (1600 psig), a liquid hourly space velocity (LHSV) from about 0.5 to about 2 $hr^{-1}$ and preferably about 0.7 to about 1.5 $hr^{-1}$ and a hydrogen rate of about 421 $Nm^3/m^3$ oil (2,500 scf/bbl) to about 1,685 $Nm^3/m^3$ oil (10,000 scf/bbl).

Suitable hydrotreating catalysts are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal is selected from palladium and platinum. More than one type of hydrotreating catalyst may be used in the same hydrotreating reactor 30. The Group VIII metal is typically present in an amount ranging from about 2 to about 20 wt %, preferably from about 4 to about 12 wt %. The Group VI metal will typically be present in an amount ranging from about 1 to about 25 wt %, preferably from about 2 to about 25 wt %.

Preferred hydrotreating reaction conditions include a temperature from about 290° C. (550° F.) to about 455° C. (850° F.), suitably 316° C. (600° F.) to about 427° C. (800° F.) and preferably 343° C. (650° F.) to about 399° C. (750° F.), a pressure from about 2.1 MPa (gauge) (300 psig), preferably 4.1 MPa (gauge) (600 psig) to about 20.6 MPa (gauge)

(3000 psig), suitably 12.4 MPa (gauge) (1800 psig), preferably 6.9 MPa (gauge) (1000 psig), a liquid hourly space velocity of the fresh hydrocarbonaceous feedstock from about 0.1 $hr^{-1}$, suitably 0.5 $hr^{-1}$, to about 4 $hr^{-1}$, preferably from about 1.5 to about 3.5 $hr^{-1}$, and a hydrogen rate of about 90 $Nm^3/m^3$ (530 scf/bbl), to about 1,011 $Nm^3/m^3$ oil (6,000 scf/bbl), preferably about 168 $Nm^3/m^3$ oil (1,000 scf/bbl) to about 674 $Nm^3/m^3$ oil (4,000 scf/bbl), with a hydrotreating catalyst or a combination of hydrotreating catalysts.

The hydroprocessing reactor 30 provides a hydroprocessed effluent stream that exits the hydroprocessing reactor 30 in a hydroprocessed effluent line 32. The hydroprocessed effluent stream may be separated in the separation section 14 comprising one or more separators into a separated liquid hydroprocessed stream and a separated gaseous hydroprocessed stream. The separation section 14 is in downstream communication with the hydroprocessing reactor 30.

The hydroprocessed effluent stream in the hydroprocessed effluent line 32 may in an aspect be heat exchanged with the hydrocarbon feed stream in line 26 to be cooled before entering a hot separator 34. The hot separator separates the hydroprocessed effluent stream to provide a hydrocarbonaceous, hot separated gaseous stream in a hot overhead line 36 and a hydrocarbonaceous, hot separated liquid hydroprocessed stream in a hot bottoms line 38. The hot separator 34 may be in downstream communication with the hydroprocessing reactor 30. The hot separator 34 operates at about 177° C. (350° F.) to about 371° C. (700° F.) and preferably operates at about 232° C. (450° F.) to about 315° C. (600° F.). The hot separator 34 may be operated at a slightly lower pressure than the hydroprocessing reactor 30 accounting for pressure drop through intervening equipment. The hot separator may be operated at pressures between about 3.4 MPa (gauge) (493 psig) and about 20.4 MPa (gauge) (2959 psig). The hydrocarbonaceous, hot separated gaseous stream in the hot overhead line 36 may have a temperature of the operating temperature of the hot separator 34.

The hot separated gaseous stream in the hot overhead line 36 may be cooled before entering a cold separator 40. As a consequence of the reactions taking place in the hydroprocessing reactor 30 wherein nitrogen, chlorine and sulfur are removed from the feed, ammonia and hydrogen sulfide are formed. At a characteristic sublimation temperature, ammonia and hydrogen sulfide will combine to form ammonium bisulfide and ammonia, and chlorine will combine to form ammonium chloride. Each compound has a characteristic sublimation temperature that may allow the compound to coat equipment, particularly heat exchange equipment, impairing its performance. To prevent such deposition of ammonium bisulfide or ammonium chloride salts in the hot overhead line 36 transporting the hot gaseous stream, a suitable amount of wash water may be introduced into the hot overhead line 36 upstream of a cooler at a point in the hot overhead line 36 where the temperature is above the characteristic sublimation temperature of either compound.

The hot separated gaseous stream in the hot overhead line 36 may be taken as a process stream taken from said hydroprocessed effluent stream in hydroprocessed effluent line 32 and separated in the cold separator 40 to provide a cold separated gaseous hydroprocessed stream comprising a hydrogen-rich gas stream in a cold overhead line 42 and a cold separated liquid hydroprocessed stream in a cold bottoms line 44. The cold separator 40 serves to separate hydrogen rich gas from hydrocarbon liquid in the hydroprocessed effluent for recycle to the hydroprocessing reactor 30 in the cold overhead line 42. The cold separator 40, therefore, is in downstream communication with the hot overhead line 36 of the hot separator 34 and the hydroprocessing reactor 30. The cold separator 40 may be operated at about 100° F. (38° C.) to about 150° F. (66° C.), suitably about 115° F. (46° C.) to about 145° F. (63° C.), and just below the pressure of the hydroprocessing reactor 30 and the hot separator 34 accounting for pressure drop through intervening equipment to keep hydrogen and light gases in the overhead and normally liquid hydrocarbons in the bottoms. The cold separator 40 may be operated at pressures between about 3 MPa (gauge) (435 psig) and about 20 MPa (gauge) (2,901 psig). The cold separator 40 may also have a boot for collecting an aqueous phase. The cold separated liquid hydroprocessed stream in the cold bottoms line 44 may have a temperature of the operating temperature of the cold separator 40.

The cold separated gaseous stream in the cold overhead line 42 is rich in hydrogen. Thus, hydrogen can be recovered from the cold gaseous stream. The cold gaseous stream in the cold overhead line 42 may be passed through a trayed or packed recycle scrubbing column 46 where it is scrubbed by means of a scrubbing extraction liquid such as an aqueous solution fed by line 47 to remove acid gases including hydrogen sulfide and carbon dioxide by extracting them into the aqueous solution. Preferred aqueous solutions include amines such as alkanolamines DEA, MEA, and MDEA. SELEXOL available from UOP LLC in Des Plaines, Ill. is a preferred scrubbing solution. Other amines can be used in place of or in addition to the preferred amines. The lean amine contacts the cold gaseous stream and absorbs acid gas contaminants such as hydrogen sulfide and carbon dioxide. The resultant "sweetened" cold gaseous stream is taken out from an overhead outlet of the recycle scrubber column 46 in a recycle scrubber overhead line 48, and a rich amine is taken out from the bottoms at a bottom outlet of the recycle scrubber column in a recycle scrubber bottoms line 49. The spent scrubbing liquid from the bottoms may be regenerated and recycled back to the recycle scrubbing column 46 in line 47 (not shown). The scrubbed hydrogen-rich stream emerges from the scrubber via the recycle scrubber overhead line 48 and may be compressed in a recycle compressor 50 to provide the recycle hydrogen stream in the recycle line 22. The recycle hydrogen stream in the recycle line 22 may be supplemented with make-up hydrogen stream in the make-up line 24 to provide the hydrogen stream in hydrogen line 20. A portion of the recycle hydrogen stream in the recycle line 22 may be routed to the intermediate catalyst bed outlets in the hydroprocessing reactor 30 to control the inlet temperature of the subsequent catalyst bed (not shown). The recycle scrubbing column 46 may be operated with a gas inlet temperature between about 38° C. (100° F.) and about 66° C. (150° F.) and an overhead pressure of about 3 MPa (gauge) (435 psig) to about 20 MPa (gauge) (2900 psig).

In an aspect, the hot liquid separated hydroprocessed stream in the hot bottoms line 38 may be taken as a hot separated liquid hydroprocessed stream and stripped in the product recovery unit 16. In a further optional aspect, the hot liquid separated hydroprocessed stream may optionally be let down in pressure and flashed in a hot flash drum 52 to separate the hot separated liquid hydroprocessed stream in the hot bottoms line 38. Accordingly, a stripping column 70 may be in downstream communication with the hot flash drum 52 and/or the hot flash bottoms line 56. The hot flash drum 52 may be any separator that splits the liquid hydroprocessed effluent into vapor and liquid fractions. The hot flash drum 52 may be in direct, downstream communication with the hot bottoms line 38 and in downstream communication with the hydroprocessing reactor 30. The hot flash drum 52 may be operated at the same temperature as the hot separator 34 but at a lower pressure of between about 1.4 MPa (gauge) (200 psig) and about 6.9 MPa (gauge) (1000 psig), suitably no more than about 3.8 MPa (gauge) (550 psig). The flash hot separated liquid hydroprocessed stream in the hot flash bottoms line 56 taken from the hot separated liquid hydroprocessed stream in the hot bottoms line 38 may be taken as a separated liquid hydroprocessed stream and stripped in the product recovery unit 16. The flash hot separated liquid hydroprocessed stream in the hot flash bottoms line 56 may have a temperature of the operating temperature of the hot flash drum 52.

In an aspect, the cold liquid separated hydroprocessed stream in the cold bottoms line 44 may be taken as a cold separated liquid hydroprocessed stream and stripped in the product recovery unit 16. In a further optional aspect, the cold liquid separated hydroprocessed stream may optionally be let down in pressure and flashed in a cold flash drum 60 to separate the cold separated liquid hydroprocessed stream in the cold bottoms line 44. Accordingly, a stripping column 70 may be in downstream communication with the cold flash drum 60 and/or the cold flash bottoms line 64. The cold flash drum 60 may be any separator that splits hydroprocessed effluent into vapor and liquid fractions. The cold flash drum 60 may be in direct downstream communication with the cold bottoms line 44 of the cold separator 40 and in downstream communication with the hydroprocessing reactor 30.

In a further aspect, the flash hot gaseous separated stream in the hot flash overhead line 54 may be stripped as a separated gaseous hydroprocessed stream in the product recovery unit 16. In a further optional aspect, the flash hot separated gaseous hydroprocessed stream may be cooled and also separated in the cold flash drum 60. The cold flash drum 60 may separate the cold separated liquid hydroprocessed stream in line 44 and/or the flash hot separated gaseous hydroprocessed stream in the hot flash overhead line 54 to provide a flash cold gaseous separated hydroprocessed stream in a cold flash overhead line 62 and a flash cold liquid separated hydroprocessed stream in a cold flash bottoms line 64.

The cold flash drum 60 may be in downstream communication with the cold bottoms line 44 of the cold separator 40, the hot flash overhead line 54 of the hot flash drum 52 and the hydroprocessing reactor 30. The cold separated liquid hydroprocessed stream in cold bottoms line 44 and the flash hot gaseous stream in the hot flash overhead line 54 may enter into the cold flash drum 60 either together or separately. In an aspect, the hot flash overhead line 54 may join the cold bottoms line 44 and the flash hot gaseous stream and the cold separated hydroprocessed stream together enter the cold flash drum 50 in a cold flash feed line 58. The cold flash drum 50 may be operated at the same temperature as the cold separator 40 but typically at a lower pressure of between about 1.4 MPa (gauge) (200 psig) and about 6.9 MPa (gauge) (1000 psig) and preferably between about 3.0 MPa (gauge) (435 psig) and about 3.8 MPa (gauge) (550 psig). A flashed aqueous stream may be removed from a boot in the cold flash drum 60. The flash cold liquid separated hydroprocessed stream in the cold flash bottoms line 64 may have the same temperature as the operating temperature of the cold flash drum 60. The flash cold separated gaseous hydroprocessed stream in the cold flash overhead line 62 contains substantial hydrogen that may be recovered.

The product recovery section 16 may include the stripping column 70, an optional product fractionation column 100, a scrubber column 120, and an absorber column 150. The stripping column 70 may be in downstream communication with a bottoms line in the separation section 14 for stripping volatiles from the hydroprocessed streams. For example, the stripping column 70 may be in downstream communication with the hot bottoms line 38 and/or the hot flash bottoms line 56 and the cold bottoms line 44 and/or the cold flash bottoms line 64. In an aspect, the stripping column 70 may be a vessel that contains a cold stripping column 72 and a hot stripping column 86 with a wall that isolates each of the stripping columns 72, 86 from the other. The cold stripping column 72 may be in downstream communication with the hydroprocessing reactor 30, the cold bottoms line 44 and/or the cold flash bottoms line 64 for stripping the cold separated liquid hydroprocessed stream. The hot stripping column 86 may be in downstream communication with the hydroprocessing reactor 30 and the hot bottoms line 38 and/or the hot flash bottoms line 56 for stripping the hot separated liquid hydroprocessed stream which is hotter than the cold hydroprocessed stream. In an aspect, the liquid separated hydroprocessed stream may be the flash cold liquid separated hydroprocessed stream in the cold flash bottoms line 64. The liquid hot separated hydroprocessed stream may be hotter than the cold separated hydroprocessed stream, by at least 25° C. and preferably at least 50° C.

The cold separated liquid hydroprocessed stream in the cold bottoms line 44 or the cold separated liquid hydroprocessed stream in the cold flash bottoms line 64 taken from the cold separated liquid hydroprocessed stream in the cold bottoms line 44 comprising at least a portion of the hydroprocessed effluent stream in the hydroprocessed effluent line 32 may be heated and stripped in the cold stripping column 72 from an inlet which may be in a top half of the column. The cold stripping column 72 may be reboiled by heat exchange with a suitable hot stream or in a fired heater to provide the necessary stripping vapor (not shown). Alternately, a cold stripping media which is an inert gas such as steam from a cold stripping media line may be used to heat the column, but the stripped product may require drying to meet moisture product specifications. The cold stripping column 72 provides a cold overhead stripper gaseous stream of naphtha, hydrogen, hydrogen sulfide, steam and other gases in an overhead line 76 and a cold stripped liquid stream in a cold stripper bottoms line 78 sourced from the separation section 14. The cold overhead stripper gaseous stream may be condensed and separated in a receiver 80. A net stripper overhead line 82 from the receiver 80 carries a net stripper gaseous stream for further processing. Unstabilized liquid naphtha from the bottoms of the receiver 80 may be split between a reflux portion refluxed to the top of the cold stripping column 72 and a stripper liquid overhead stream which may be transported to naphtha recovery in a stripper overhead bottoms line 84. A sour water stream may be collected from a boot of the overhead receiver 80.

The cold stripping column 72 may be operated with a bottoms temperature between about 149° C. (300° F.) and about 288° C. (550° F.), preferably no more than about 260° C. (500° F.), and an overhead pressure of about 0.35 MPa (gauge) (50 psig), preferably no less than about 0.70 MPa (gauge) (100 psig), to no more than about 2.0 MPa (gauge) (290 psig). The temperature in the overhead receiver 80 ranges from about 38° C. (100° F.) to about 66° C. (150° F.) and the pressure is essentially the same as in the overhead of the cold stripping column 72.

The cold liquid hydroprocessed stream in the cold stripper bottoms line 78 may comprise predominantly $C_5$+ hydrocarbons such as naphtha boiling materials. Consequently, the cold liquid stream in cold stripper bottoms line 78 may be fed to a gasoline pool or heated and fed to a product fractionation column 100.

The optional product fractionation column 100 may be in downstream communication with the cold stripped bottoms line 78 of the cold stripping column 72 and the stripping column 70. In an aspect, the product fractionation column 100 may comprise more than one fractionation column. The product fractionation column 100 may be in downstream communication with one, some or all of the hot separator 34, the cold separator 40, the hot flash drum 52 and the cold flash drum 60.

The hot separated liquid hydroprocessed stream in the hot bottoms line 38 or the hot separated liquid hydroprocessed stream in the hot flash bottoms line 56 taken from the hot separated liquid hydroprocessed stream in the hot bottoms line 38 comprising at least a portion of the hydroprocessed effluent stream in the hydroprocessed effluent line 32 may be heated and stripped in the hot stripping column 86 from an inlet which may be in a top half of the column. The hot stripping column 86 may be reboiled in a fired heater or by heat exchange with a suitable hot stream to provide the necessary stripping vapor (not shown). Alternately, a hot stripping media which is an inert gas such as steam from a hot stripping media line may be used to heat the column, but the stripped product may require drying to meet moisture product specifications. The hot stripping column 86 provides a hot stripper overhead gaseous stream of naphtha, hydrogen, hydrogen sulfide, steam and other gases in a hot stripper overhead line 90 and hot stripped liquid stream in a hot stripper bottoms line 92 sourced from the separation section 14. The overhead line 90 may be condensed and a portion refluxed to the hot stripping column 86. However, in an embodiment, the hot stripped overhead stream in the hot stripper overhead line 90 from the overhead of the hot stripping column 86 may be fed into the cold stripping column 72 directly in an aspect without first condensing or refluxing. The inlet for the cold bottoms line 38 carrying the cold separated liquid hydroprocessed stream or the cold flash bottoms line 64 carrying the flash cold separated liquid hydroprocessed stream may be at a higher elevation than the inlet for the overhead line 90. The hot stripping column 86 may be operated with a bottoms temperature between about 160° C. (320° F.) and about 360° C. (680° F.) and an overhead pressure of about 0.35 MPa (gauge) (50 psig), preferably at least about 0.70 MPa (gauge) (100 psig), to about 2.0 MPa (gauge) (292 psig).

The hot liquid hydroprocessed stream in the hot stripped bottoms line 92 comprises diesel materials and may be forwarded to a diesel pool. Alternatively, at least a portion of the hot liquid hydroprocessed stream in the hot stripped bottoms line 92 may be heated and fed to the product fractionation column 100. It is also contemplated that the lean absorbent oil stream in lean absorbent line 152 be taken from the hot stripped liquid stream in the hot stripper bottoms line 92. It is further contemplated that if a single stripper column 70 be used that provides a single stripped liquid stream, the absorbent oil stream may be taken from the single stripped liquid stream from the stripper bottoms.

The optional product fractionation column 100 may be in downstream communication with the hot stripped bottoms line 92 of the hot stripping column 86. The hot liquid hydroprocessed stream in line 92 may be at a hotter temperature than the cold liquid hydroprocessed stream in line 78. In an aspect, the hot liquid hydroprocessed stream may be heated and fed to a prefractionation separator 94 for separation into a vaporized hot hydroprocessed stream in a prefractionation overhead line 96 and a prefractionation hot liquid hydroprocessed stream in a prefractionation bottoms line 98. The prefractionation hot liquid hydroprocessed stream may be heated in a fractionation furnace and fed to the product fractionation column 100 in the prefractionation bottoms line 98 at an elevation below the elevation at which the prefractionation overhead line 96 feeds the vaporized hot liquid hydroprocessed stream to the product fractionation column 100.

The optional product fractionation column 100 may be in downstream communication with the cold stripping column 72 and the hot stripping column 86 and may comprise more than one fractionation column for separating stripped streams into product streams. The product fractionation column 100 may strip the cold liquid hydroprocessed stream and the hot liquid hydroprocessed stream with an inert stripping media stream such as steam from line 102 to provide several product streams. The product streams from the product fractionation column 100 may include a net fractionated overhead stream comprising naphtha in a net overhead line 104, an optional heavy naphtha stream in line 106 from an upper side cut outlet, a kerosene stream carried in line 108 from a middle side cut outlet and a diesel stream in line 110 from a lower side cut outlet. An unconverted oil stream may be provided in a bottoms line 112 which may be recycled to the hydroprocessing reactor 30 or further processed in another way. Heat may be removed from the fractionation column 100 by cooling at least a portion of the product streams and sending a portion of each cooled stream back to the fractionation column. These product streams may also be stripped to remove light materials to meet product purity requirements. A fractionated overhead stream in an overhead line 114 may be condensed and separated in a receiver 116 with a portion of the condensed liquid being refluxed back to the fractionation column 100. The net fractionated overhead stream in line 104 may be further processed or recovered as naphtha product. The product fractionation column 100 may be operated with a bottoms temperature between about 260° C. (500° F.), and about 385° C. (725° F.), preferably at no more than about 350° C. (650° F.), and at an overhead pressure between about 7 kPa (gauge) (1 psig) and about 69 kPa (gauge) (10 psig). A portion of the unconverted oil stream in the bottoms line 112 may be reboiled and returned to the product fractionation column 100 instead of adding an inert stripping media stream such as steam in line 102 to heat to the fractionation column 100.

The net stripper gaseous stream in the net stripper overhead line 82 from the receiver 80 is typically at a pressure of about 0.35 MPa (gauge) (50 psig) to about 2.0 MPa (gauge) (290 psig) and contains hydrogen, hydrogen sulfide, dry gas, $C_1$ and $C_2$ hydrocarbons, and liquefied petroleum gas $C_3$ and $C_4$ hydrocarbons. The net stripper gaseous stream may also contain $C_5$+ hydrocarbon materials which represents a loss in recovery. In some locations, limits may also apply to the $C_5$+ concentration in this net stripper gaseous stream. As such, $C_5$+ hydrocarbon materials should be recovered from the net stripper gaseous stream in the net stripper overhead line 82.

In an aspect, the net stripper gaseous stream in the net stripper overhead line 82 may be scrubbed of its acid gases in a scrubber column 120. The net stripper gaseous stream may be scrubbed by contact with a scrubbing solvent in the scrubber column 120 to remove acid gases including hydrogen sulfide and carbon dioxide. A suitable scrubbing solvent includes lean amines such as alkanolamines, DEA, MEA, and MDEA. SELEXOL available from UOP LLC in Des Plaines, Ill. is a preferred solvent. Other amines can be used in place of or in addition to the preferred amines. The lean solvent fed from a solvent line 122 at the top of the scrubbing column contacts the net stripper gaseous stream to absorb acid gases therefrom together by countercurrent contact with the solvent stream. Trays or other media in the scrubber column may facilitate contact between the solvent and the stripper gaseous stream. The solvent absorbs acid gas contaminants such as hydrogen sulfide and carbon dioxide. A resultant "sweetened" scrubbed net stripper gaseous stream may be withdrawn through an overhead outlet of the scrubber column 120, and an acid gas-rich solvent stream may be taken out from the bottoms at a bottom outlet of the scrubber column in a scrubber bottoms line 124. The acid gas-rich solvent may undergo regeneration to remove the hydrogen sulfide for processing to generate elemental sulfur and other acid gases and recycled to the scrubber column 120 in the solvent line 122. The scrubbing column 120 may be operated with a gas inlet temperature between about 30° C. (86° F.) and about 66° C. (150° F.) and an overhead pressure of between about 0.35 MPa (gauge) (50 psig) and about 2.0 MPa (gauge) (290 psig) and preferably between about 0.7 MPa (gauge) (100 psig) and about 1.4 MPa (gauge) (200 psig).

The scrubbed stripper gaseous stream may be fed to an absorber column 150, but it may be preferable to remove residual amines from the scrubbed stripper gaseous stream by washing the scrubbed stripper gaseous stream with water in a water wash column 130. In an embodiment, the water wash column 130 may be stacked over the scrubber column 120 in a stacked column 140 comprising the water wash column 130 and the scrubber column 120.

In the stacked column a chimney tray 126 may allow the scrubbed stripper gaseous stream to exit a top of the scrubber column 120 and enter a bottom of the water wash column 130. A lean water stream in a water line 132 may enter the water wash column 130 near a top thereof to counter currently contact the scrubbed stripper gaseous stream entering at the bottom of the water wash column 130 from the chimney tray 126. The water stream absorbs amines residing in the scrubbed, stripper gaseous stream leftover from the scrubber solvent. Trays or other media in the water wash column 130 may facilitate contact between the water stream and the scrubbed, stripper gaseous stream. An amine-rich water stream may exit the bottom of the water wash column 130 in a rich water line 134. The chimney tray 126 does not let liquid exit from the water wash column 130 and enter the scrubber column 120. A washed, scrubbed stripper gaseous stream exits the top of the water wash column 130 depleted of residual amines in a transfer line 136. The transfer line 136 delivers the washed, scrubbed stripper gaseous stream to the absorber column 150.

The absorber column 150 which may comprise trays receives the washed, scrubbed stripper gaseous stream in the transfer line 136 at a bottom of the column. The absorber column 150 may include an upper inlet at a location near or above a middle of the absorber column 150 which is at an elevation that is above the lower inlet for the washed, scrubbed stripper gaseous stream. At the upper inlet, the absorber column 150 receives a lean absorbent oil stream from a lean absorbent oil line 152 which may comprise a naphtha or heavier stream.

The lean absorbent oil stream in the lean absorbent line 152 may be provided from a stripped liquid stream from the stripping column 70. For example, the cold stripped liquid stream in the cold stripper bottoms line 78 may be split into a lean absorbent oil stream in a lean absorbent line 152 at a flow rate regulated by a control valve thereon and a remaining stripped liquid stream in a remainder stripped liquid line 156. The lean absorbent oil stream in the lean absorbent line 152 may comprise about 5 to about 10 wt % of the stripped liquid stream in the cold stripper bottoms line 78. In an aspect, the lean absorbent oil may be cooled after splitting and transported to the absorber 150. If the stripping column 70 uses steam stripping, the cold stripped liquid stream may require drying, such as in a vacuum drier, to remove moisture down to 25 to about 125 wppm water. In the absorber 150, the lean absorbent oil and the washed, scrubbed stripper gaseous stream are counter currently contacted. In the absorber column 150, the lean absorbent oil absorbs $C_5$+ hydrocarbons from the washed, scrubbed stripper gaseous stream. The hydrocarbons absorbed from the washed, scrubbed stripper gaseous stream by the absorbent oil are predominantly $C_5$+ hydrocarbons. For example, of the hydrocarbons absorbed by the absorbent oil from the washed, scrubbed stripper gaseous stream, at least 50 wt % are $C_5$+ hydrocarbons.

The $C_5$+-rich absorbent oil exits the bottom of the absorber column 150 in a $C_5$+-rich absorbent line 154 at a flow rate regulated by a control valve thereon. The $C_5$+-rich absorbent stream in rich absorbent line 154 is added to remaining stripped liquid stream in a remainder stripped liquid line 156 from the stripper column 70 in the cold stripper bottoms line 78. The recombined stream of the remaining stripped liquid stream in the remainder stripped liquid line 156 and the rich absorbent stream in rich absorbent line 154 may be transported to the product fractionation column 100 in a recombined line 158. The absorbed $C_5$+ hydrocarbons in the rich absorbent stream augment the recovery of $C_5$+ hydrocarbons in the product fractionation column 100 without affecting its properties such as hydrogen sulfide and water concentrations and flash point. It is contemplated that if no product fractionation column 100 be utilized, the recombined stream in recombined line 158 be directed to the diesel or gasoline product pool.

The absorber column 150 operates at a temperature of about 34° C. (93° F.) to 60° C. (140° F.) and an overhead pressure of between about 0.35 MPa (gauge) (50 psig) and about 1.4 MPa (gauge) (200 psig) and preferably between about 0.7 MPa (gauge) (100 psig) and about 1.0 MPa (gauge) (145 psig).

An absorber off gas stream comprising remaining absorbed, washed, scrubbed stripper gaseous stream gas components depleted of $C_5$+ hydrocarbons exits the absorber column at an overhead outlet through an absorber overhead line 160. The absorber off-gas stream will be able to meet applicable $C_5$+ hydrocarbon specifications.

Any of the above lines, units, separators, columns, surrounding environments, zones or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect.

Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring components, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

EXAMPLE

We stripped a separated liquid hydroprocessed stream in a stripper column with steam. The stripped liquid stream from the stripper bottoms comprised 218,285 kg/hr of predominately $C_5$+ hydrocarbons at about 271° C. (519° F.). We cooled the stripped liquid stream to 107° C. (225° F.), vacuum dried it to remove water and cooled it to 50° C. (122° F.). An absorbent oil slipstream consisting of 5 vol % of the cool, dried stripped liquid stream was contacted with a net stripper gaseous stream that had been scrubbed of acid gases and water washed to remove amines. The absorbent oil slipstream absorbed $C_5$+ hydrocarbons from the net stripper gaseous stream. The contacted $C_5$+-rich absorbent oil slipstream was recombined with the remaining stripped liquid stream downstream of the slipstream off take. As a result, an additional 113.6 kg/hr of $C_5$+ hydrocarbons were recovered in the recombined stripped liquid stream, representing 908 MT/yr. of additional product. The recombined stripped liquid stream had negligible change in the product flash point and concentrations of water and hydrogen sulfide.

Specific Embodiments

While the following is described in conjunction with specific embodiments, it will be understood that this description is intended to illustrate and not limit the scope of the preceding description and the appended claims.

A first embodiment of the invention is a process for recovering hydrocarbons comprising hydroprocessing a hydrocarbon feed stream in a hydroprocessing reactor to provide a hydroprocessed effluent stream; stripping a hydroprocessed stream taken from the hydroprocessed effluent stream to provide a stripper gaseous stream and a stripped liquid stream; and absorbing $C_5$+ hydrocarbons from the stripper gaseous stream by contact with an absorbent stream to provide a $C_5$+-rich absorbent stream. An embodiment of the invention is one, any or all of prior embodiments in this paragraph up through the first embodiment in this paragraph wherein $C_5$+ hydrocarbons are a predominant material absorbed from the stripper gaseous stream in the rich absorbent stream. An embodiment of the invention is one, any or all of prior embodiments in this paragraph up through the first embodiment in this paragraph further comprising taken the absorbent stream from the stripped liquid stream. An embodiment of the invention is one, any or all of prior embodiments in this paragraph up through the first embodiment in this paragraph wherein the stripping step comprises condensing a stripper overhead stream and separating the stripper gaseous stream from a stripped liquid overhead stream. An embodiment of the invention is one, any or all of prior embodiments in this paragraph up through the first embodiment in this paragraph further comprising scrubbing acid gases from the stripper gaseous stream by contact with a solvent to provide a scrubbed stripper gaseous stream and absorbing $C_5$+ hydrocarbons from the scrubbed stripper gaseous stream. An embodiment of the invention is one, any or all of prior embodiments in this paragraph up through the first embodiment in this paragraph further comprising washing amines from the scrubbed stripper gaseous stream to provide a washed, scrubbed stripper gaseous stream and absorbing $C_5$+ hydrocarbons from the washed, scrubbed stripper gaseous stream. An embodiment of the invention is one, any or all of prior embodiments in this paragraph up through the first embodiment in this paragraph further comprising adding the rich absorbent stream to the stripped liquid stream. An embodiment of the invention is one, any or all of prior embodiments in this paragraph up through the first embodiment in this paragraph further comprising splitting the stripped liquid stream into an absorbent stream and a remaining stripped liquid stream and the rich absorbent stream is added to the remaining liquid stream. An embodiment of the invention is one, any or all of prior embodiments in this paragraph up through the first embodiment in this paragraph further comprising separating the hydroprocessed effluent stream in a separation section comprising a separator to provide a separated liquid hydroprocessed stream comprising the hydroprocessed stream and a separated gaseous hydroprocessed stream. An embodiment of the invention is one, any or all of prior embodiments in this paragraph up through the first embodiment in this paragraph wherein the separation step further comprises separating a process stream taken from the hydroprocessed effluent stream in a separator to provide a separated gaseous hydroprocessed stream and a separated liquid hydroprocessed stream and taking the hydroprocessed stream from the separated liquid hydroprocessed stream. An embodiment of the invention is one, any or all of prior embodiments in this paragraph up through the first embodiment in this paragraph wherein the separation step further comprises separating the hydroprocessed effluent stream in a hot separator to provide a hot separated liquid hydroprocessed stream and a hot separated gaseous stream comprising the process stream taken from the hydroprocessed effluent stream. An embodiment of the invention is one, any or all of prior embodiments in this paragraph up through the first embodiment in this paragraph, further comprising at least one of sensing at least one parameter of the process, and generating or transmitting a signal or data from the sensing.

A second embodiment of the invention is a process for recovering hydrocarbons comprising hydroprocessing a hydrocarbon feed stream in a hydroprocessing reactor to provide a hydroprocessed effluent stream; stripping a hydroprocessed stream taken from the hydroprocessed effluent stream to provide a stripper gaseous stream and a stripped liquid stream; condensing a stripper overhead stream; separating the stripper gaseous stream from a stripped liquid overhead stream; scrubbing acid gases from the stripper gaseous stream by contact with a solvent to provide a scrubbed stripper gaseous stream and absorbing $C_5$+ hydrocarbons from the scrubbed stripper gaseous stream by contact with an absorbent stream taken from the stripped liquid stream to provide a rich absorbent stream. An embodiment of the invention is one, any or all of prior embodiments in this paragraph up through the second embodiment in this paragraph wherein $C_5$+ hydrocarbons are a predominant material absorbed from the stripper gaseous stream in the rich absorbent stream. An embodiment of the invention is one, any or all of prior embodiments in this paragraph up through the second embodiment in this paragraph further comprising washing amines from the scrubbed stripper gaseous stream to provide a washed, scrubbed stripper gaseous stream and absorbing $C_5$+ hydrocarbons from the washed, scrubbed stripper gaseous stream. An embodiment of the invention is one, any or all of prior embodiments in this paragraph up through the second embodiment in this paragraph further comprising adding the rich absorbent stream to the stripped liquid stream. An embodiment of the invention is one, any or all of prior embodiments in this paragraph up through the second embodiment in this paragraph further comprising splitting the stripped liquid stream into an absorbent stream and a remaining stripped liquid stream and the rich absorbent stream is added to the remaining liquid stream. An embodiment of the invention is one, any or all of prior embodiments in this paragraph up through the second embodiment in this paragraph further comprising separating the hydroprocessed effluent stream in a separation section comprising a separator to provide a separated liquid hydroprocessed stream comprising the hydroprocessed stream and a separated gaseous hydroprocessed stream. An embodiment of the invention is one, any or all of prior embodiments in this paragraph up through the second embodiment in this paragraph wherein the separation step further comprises separating the hydroprocessed effluent stream in a hot separator to provide a hot separated liquid hydroprocessed stream and a hot separated gaseous hydroprocessed stream; separating the hot separated gaseous hydroprocessed stream in a cold separator to provide a cold separated gaseous hydroprocessed stream and a cold separated liquid hydroprocessed stream and taking the hydroprocessed stream from the cold separated liquid hydroprocessed stream.

A third embodiment of the invention is a process for recovering hydrocarbons comprising hydroprocessing a hydrocarbon feed stream in a hydroprocessing reactor to provide a hydroprocessed effluent stream; stripping a hydroprocessed stream taken from the hydroprocessed effluent stream to provide a stripper gaseous stream and a stripped liquid stream; and absorbing $C_5$+ hydrocarbons from the stripper gaseous stream by contact with an absorbent stream taken from the stripped liquid stream to provide a rich absorbent stream, wherein $C_5$+ hydrocarbons are a predominant material absorbed from the stripper gaseous stream in the rich absorbent stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for recovering hydrocarbons comprising:

hydroprocessing a hydrocarbon feed stream in a hydroprocessing reactor to provide a hydroprocessed effluent stream;

stripping a hydroprocessed stream taken from said hydroprocessed effluent stream to provide a stripper gaseous stream and a stripped liquid stream; and absorbing $C_5$+ hydrocarbons from said stripper gaseous stream by contact with an absorbent stream to provide a $C_5$+-rich absorbent stream, wherein said absorbent stream is taken from said stripped liquid stream.

2. The process of claim 1 wherein $C_5$+ hydrocarbons are a predominant material absorbed from the stripper gaseous stream in the rich absorbent stream.

3. The process of claim 1 wherein said stripping step comprises condensing a stripper overhead stream and separating said stripper gaseous stream from a stripped liquid overhead stream.

4. The process of claim 1 further comprising scrubbing acid gases from said stripper gaseous stream by contact with a solvent to provide a scrubbed stripper gaseous stream and absorbing $C_5$+ hydrocarbons from said scrubbed stripper gaseous stream.

5. The process of claim 3 further comprising washing amines from said scrubbed stripper gaseous stream to provide a washed, scrubbed stripper gaseous stream and absorbing $C_5$+ hydrocarbons from said washed, scrubbed stripper gaseous stream.

6. The process of claim 1 further comprising adding said rich absorbent stream to said stripped liquid stream.

7. The process of claim 6 further comprising splitting said stripped liquid stream into an absorbent stream and a remaining stripped liquid stream and said rich absorbent stream is added to said remaining liquid stream.

8. The process of claim 1 further comprising separating said hydroprocessed effluent stream in a separation section comprising a separator to provide a separated liquid hydroprocessed stream comprising said hydroprocessed stream and a separated gaseous hydroprocessed stream.

9. The process of claim 8 wherein said separation step further comprises separating a process stream taken from said hydroprocessed effluent stream in a separator to provide a separated gaseous hydroprocessed stream and a separated liquid hydroprocessed stream and taking said hydroprocessed stream from said separated liquid hydroprocessed stream.

10. The process of claim 9 wherein said separation step further comprises separating said hydroprocessed effluent stream in a hot separator to provide a hot separated liquid hydroprocessed stream and a hot separated gaseous stream comprising said process stream taken from said hydroprocessed effluent stream.

11. The process of claim 1, further comprising at least one of:

sensing at least one parameter of the process, and generating or transmitting a signal or data from the sensing.

12. A process for recovering hydrocarbons comprising:

hydroprocessing a hydrocarbon feed stream in a hydroprocessing reactor to provide a hydroprocessed effluent stream;

stripping a hydroprocessed stream taken from said hydroprocessed effluent stream to provide a stripper gaseous stream and a stripped liquid stream;

condensing a stripper overhead stream;

separating said stripper gaseous stream from a stripped liquid overhead stream;

scrubbing acid gases from said stripper gaseous stream by contact with a solvent to provide a scrubbed stripper gaseous stream and absorbing $C_5$+ hydrocarbons from said scrubbed stripper gaseous stream by contact with an absorbent stream taken from said stripped liquid stream to provide a rich absorbent stream.

13. The process of claim 12 wherein $C_{b\ 5}$+ hydrocarbons are a predominant material absorbed from the stripper gaseous stream in the rich absorbent stream.

14. The process of claim 12 further comprising washing amines from said scrubbed stripper gaseous stream to provide a washed, scrubbed stripper gaseous stream and absorbing $C_5$+ hydrocarbons from said washed, scrubbed stripper gaseous stream.

15. The process of claim 12 further comprising adding said rich absorbent stream to said stripped liquid stream.

16. The process of claim 15 further comprising splitting said stripped liquid stream into an absorbent stream and a remaining stripped liquid stream and said rich absorbent stream is added to said remaining liquid stream.

17. The process of claim 12 further comprising separating said hydroprocessed effluent stream in a separation section comprising a separator to provide a separated liquid hydroprocessed stream comprising said hydroprocessed stream and a separated gaseous hydroprocessed stream.

18. The process of claim 17 wherein said separation step further comprises: separating said hydroprocessed effluent stream in a hot separator to provide a hot separated liquid hydroprocessed stream and a hot separated gaseous hydroprocessed stream; separating said hot separated gaseous hydroprocessed stream in a cold separator to provide a cold separated gaseous hydroprocessed stream and a cold separated liquid hydroprocessed stream and taking said hydroprocessed stream from said cold separated liquid hydroprocessed stream.

19. A process for recovering hydrocarbons comprising:

hydroprocessing a hydrocarbon feed stream in a hydroprocessing reactor to provide a hydroprocessed effluent stream;

stripping a hydroprocessed stream taken from said hydroprocessed effluent stream to provide a stripper gaseous stream and a stripped liquid stream; and absorbing $C_5$+ hydrocarbons from said stripper gaseous stream by contact with an absorbent stream taken from said stripped liquid stream to provide a rich absorbent stream, wherein $C_5$+ hydrocarbons are a predominant material absorbed from the stripper gaseous stream in the rich absorbent stream.

* * * * *